US005134937A

United States Patent [19]

Derivi et al.

[11] Patent Number: 5,134,937

[45] Date of Patent: Aug. 4, 1992

[54] ROTARY PRINTING PRESS

[75] Inventors: Ezio Derivi, Ivrea; Aldo Balocco, Novara, both of Italy

[73] Assignee: Officine Meccaniche G. Cerutti S.p.A., Casale Monferrato, Italy

[21] Appl. No.: 732,077

[22] Filed: Jul. 18, 1991

[30] Foreign Application Priority Data

Jul. 20, 1990 [IT] Italy ..... 67572 A/90

[51] Int. Cl.[5] ..... B41F 5/00

[52] U.S. Cl. ..... 101/216; 101/153; 100/155 R

[58] Field of Search ..... 101/152, 153, 216, 375; 414/911; 100/155 R, 168

[56] References Cited

U.S. PATENT DOCUMENTS 3,738,265 6/1973 Saueressig ..... 101/152

4,527,474 7/1985 Lubke et al. ..... 101/153

4,807,527 2/1989 Knauer ..... 101/216

5,022,251 6/1991 Negrussi ..... 101/216

*Primary Examiner*—Edgar S. Burr

*Assistant Examiner*—Stephen R. Funk

*Attorney, Agent, or Firm*—Klauber & Jackson

[57] ABSTRACT

A rotary printing press for printing strip paper, wherein a pressure roller is supported for rotation at each end by a pair of jaws of a supporting device on the printing unit. The jaws are lifted and lowered, together with the pressure roller, by a lifting device, and are opened and closed by an actuating device via a prismatic joint defined by a fixed portion and a portion moving with the jaws. The two portions of the prismatic joint mate in sliding manner as the jaws are moved by the lifting device, and, when mated, rotate integral with each other.

7 Claims, 5 Drawing Sheets

ROTARY PRINTING PRESS

BACKGROUND OF THE INVENTION

The present invention relates to a rotary printing press.

Rotary printing presses usually comprise a number of printing units arranged in series and through each of which a continuous strip of paper for printing is fed along a given route by a number of feed rollers, at least some of which are powered. On each printing unit, one of the feed rollers, known as the pressure roller, provides or brining the paper strip into contact with a printing cylinder inside the unit.

The pressure roller on each unit presents supporting means enabling it to be raised or lowered according to the operating stage and comprising a rubber jacket for flexibly pressing the paper strip on to the printing cylinder.

For ensuring troublefree performance of the pressure rollers and, consequently, correct printing, the pressure rollers must be serviced and the jacket replaced regularly.

SUMMARY OF THE INVENTION

It is an object of the present invention to provide a rotary printing press enabling maintenance of the pressure rollers and replacement of the jackets to be performed as quickly and easily as possible.

According to the present invention, there is provided a rotary printing press for printing strip paper, said press comprising at least one printing unit through which said paper strip is fed; a printing cylinder supported on said printing unit; paper feed rollers assigned to said printing cylinder, one of said rollers being a pressure roller having a longitudinal axis; and a supporting device connected for rotation to each end of said pressure roller; each said supporting device being supported on said printing unit and comprising gripping means for engaging said pressure roller; a lifting device assigned to said gripping means for moving said pressure roller in a given direction between an operating position, contacting said printing cylinder, and a detached position; and clamping means for clamping said gripping means in a position engaging said pressure roller; characterised by the fact that, for each said supporting device, it also comprises lock means supported on said printing unit and connectable to said clamping means in said detached position; and an actuating device for activating and moving said lock means between an open position and a closed position for moving said clamping means to and from a position clamping said gripping means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Number 1 in the accompanying drawings indicates a rotary printing press.

Figure 1:
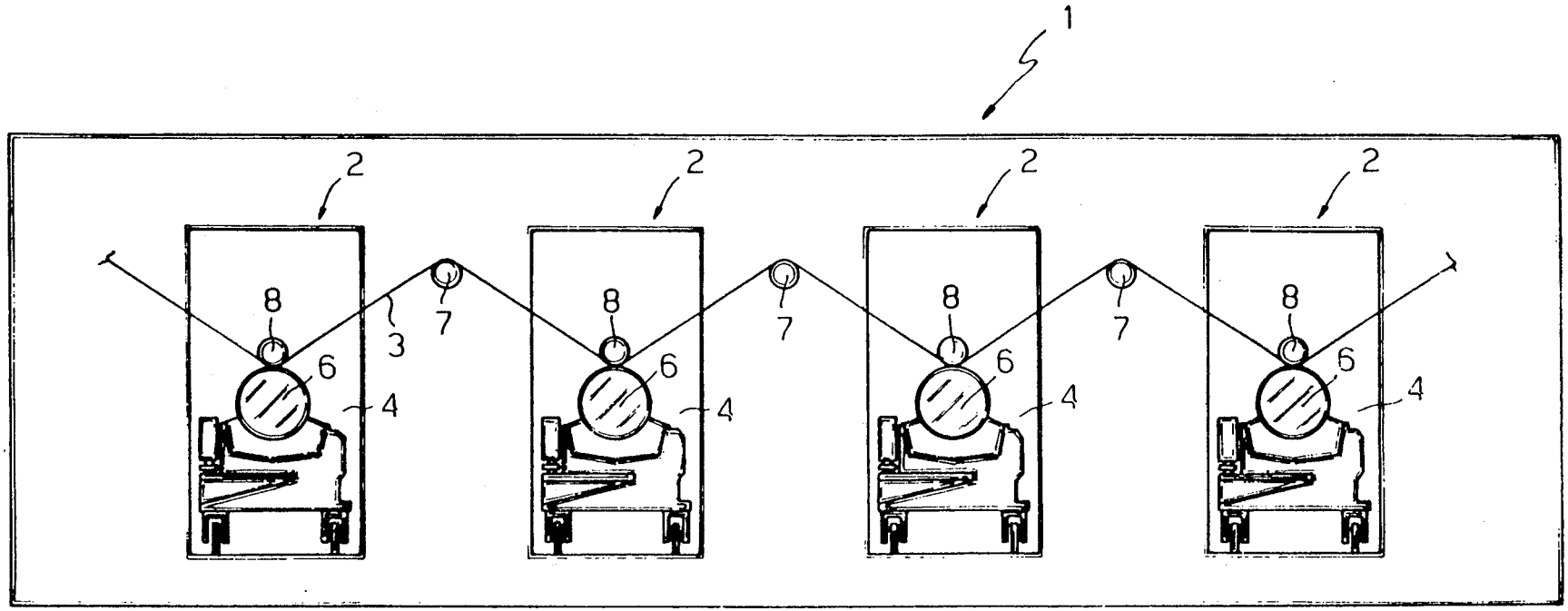
FIG. 1 shows a schematic, partial side view, with parts removed for simplicity, of a preferred embodiment of the printing press according to the present invention.

As shown in FIG. 1, printing press 1 comprises an umber of printing units 2 aligned along the route traveled by a strip 3 of paper for printing.

Each unit 2 comprises a load-bearing element consisting of a gantry 4 having two uprights 5 between which is mounted for rotation a printing cylinder 6 for printing paper strip 3 and extending perpendicular to said route. Press 1 also comprises a number of feed rollers 7, at lest some of which are powered, for feeding strip 3 along said route. On each unit 2, one of feed rollers 7, known as the pressure roller and numbered 8 in the accompanying drawings, provides for brining strip 3 into contact with respective printing cylinder 6.

In particular, each pressure roller 8 is supported on two uprights 5 by means of two identical supporting devices 9 (FIGS. 2 to 5) connected to respective opposite ends of pressure roller 8.

Figure 2:
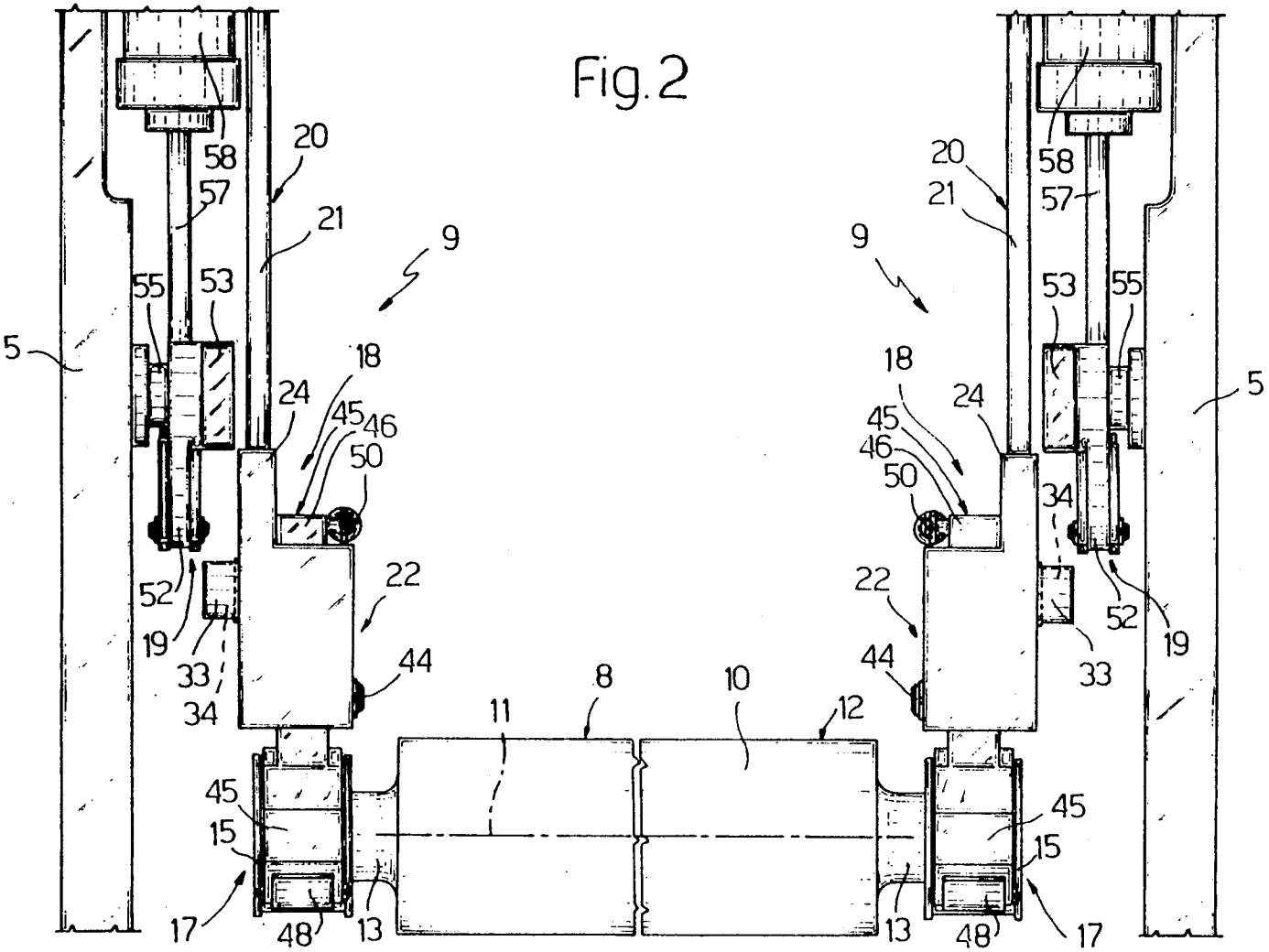
FIG. 2 shows a larger-scale front view of a detail in FIG. 1 in a first operating position.

As shown in FIG. 2, pressure roller 8 comprises a cylindrical body 10 having an axis 11 defining the rotation axis of pressure roller 8. Cylindrical body 10 is enclosed in a removable rubber jacket 12, and is fitted through with a shaft 13 coaxial with pressure roller 8 and extending between uprights 5. Shaft 13 presents end portions 14 (FIG. 3) facing respective uprights 5, having a smaller cross section than the rest of shaft 13, and housed in respective bushes 15 via the interposition of respective bearings 16.

Figure 3:
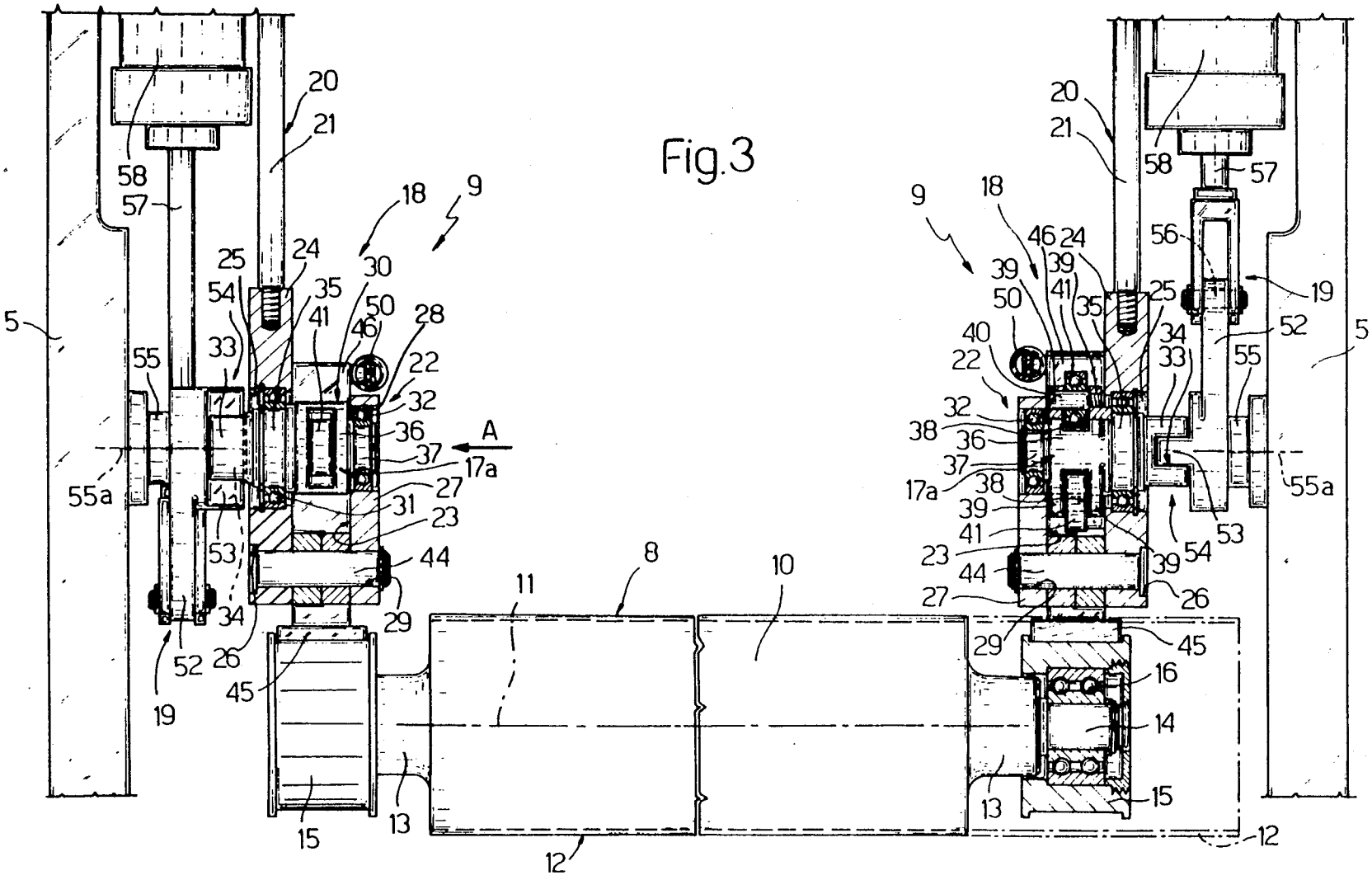
FIG. 3 shows a partially-sectioned view of the same detail as in FIG. 2 in a further two operating positions.

As both supporting devices 9 are identical, the following description will be limited to device 9 on the left in FIGS. 2 and 3.

Figure 4:
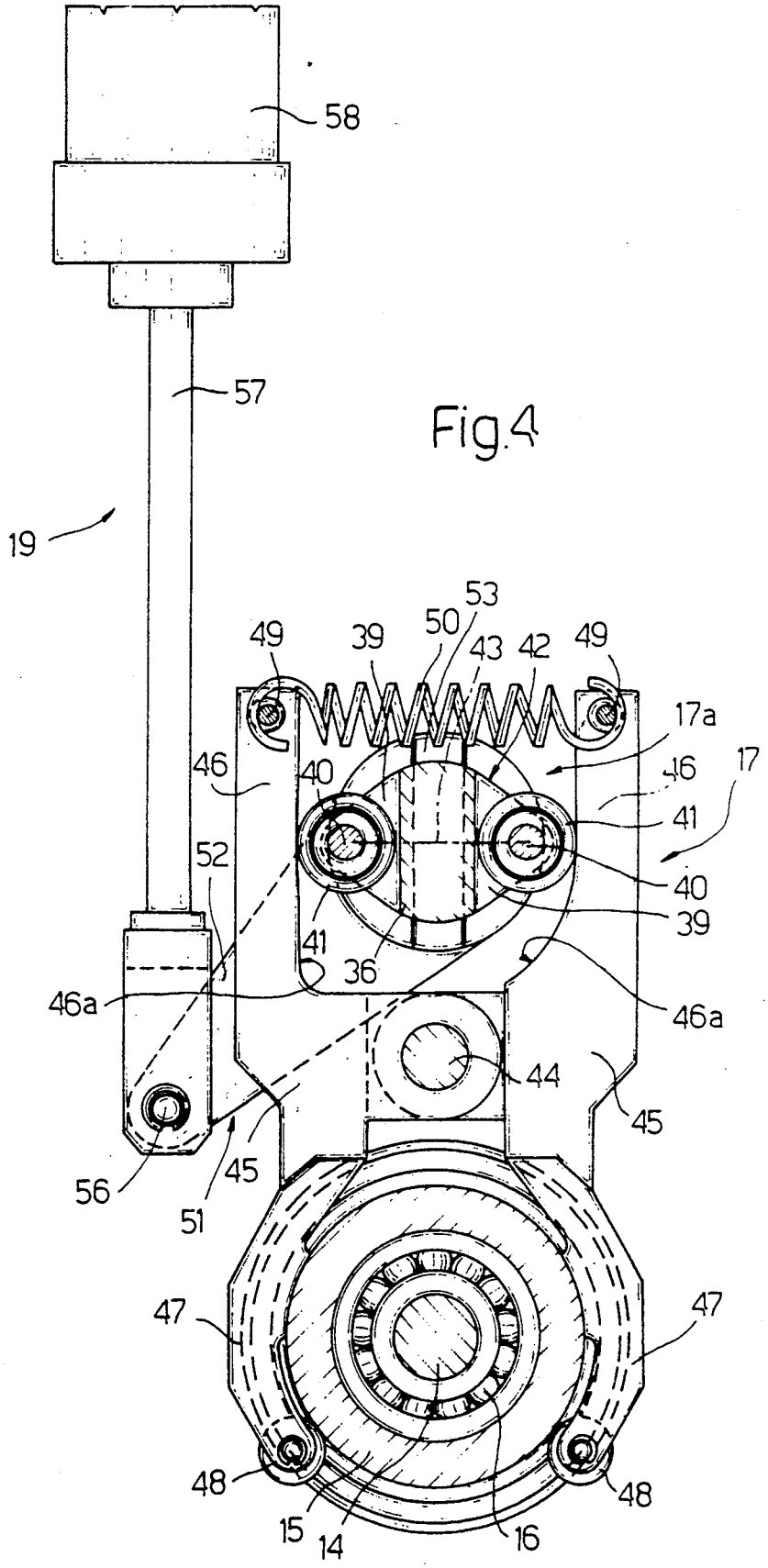
FIGS. 4 and 5 show larger-scale, partially-sectioned views, in the direction of arrow A and with parts removed for simplicity, of a detail in FIG. 3 in the two FIG. 3 operating positions.

Supporting device 9 comprises gripping means 17 engaging bush 15 in the operating position shown in FIG. 2 and as shown on the left in FIG. 3 and in FIG. 4; a clamping device 17*a* movable to and from a position clamping gripping means 17 in the closed position; a lifting device 18 for lifting and lowering gripping means 17; and an actuating device 19 for activating gripping means 17 and selectively connectable to or detachable from the same.

As shown in FIGS. 2 and 4, lifting device 18 comprises a fixed pneumatic actuator 20 having a rod 21 moving axially and vertically between a lowered position wherein gripping means 17 are disconnected from actuating device 19 (FIG. 1), and a raised position wherein gripping means 17 are connected to and controlled by actuating device 19 for releasing bush 15 (FIG. 3 onwards) as described later on.

The bottom end of rod 21 is secured to a substantially parallelepiped supporting body 22 defining an inner, rectangular-section through hole 23, extending parallel to rod 21, and partially housing gripping means 17. As shown in FIG. 3, supporting body 22 comprises a rear wall 24 facing a respective upright 5 and having two holes 25 and 26 extending parallel to axis 11 of pressure roller 8 and arranged one over the other; and a front wall 27 parallel to rear wall 24 and having two holes 28 and 29 coaxial with respective holes 25 and 26.

A shaped shaft 30, forming part of clamping device 17*a*, extends horizontally through holes 25 and 28 of walls 24 and 27 via the interposition of respective bearings 31 and 32. As shown from left to right in FIG. 3, shaft 30 comprises a first end portion 33 projecting rearwards from rear wall 24 towards respective upright 5 and having a groove 34; a first round-section intermediate portion 35 extending inside hole 25 in rear wall 24; a second intermediate portion 36 having a substantially ellipsoidal section (FIGS. 4 and 5) and extending inside hole 23 through supporting body 22; and a second round-section end portion 37 extending inside hole 28 in front wall 27.

Figure 5:
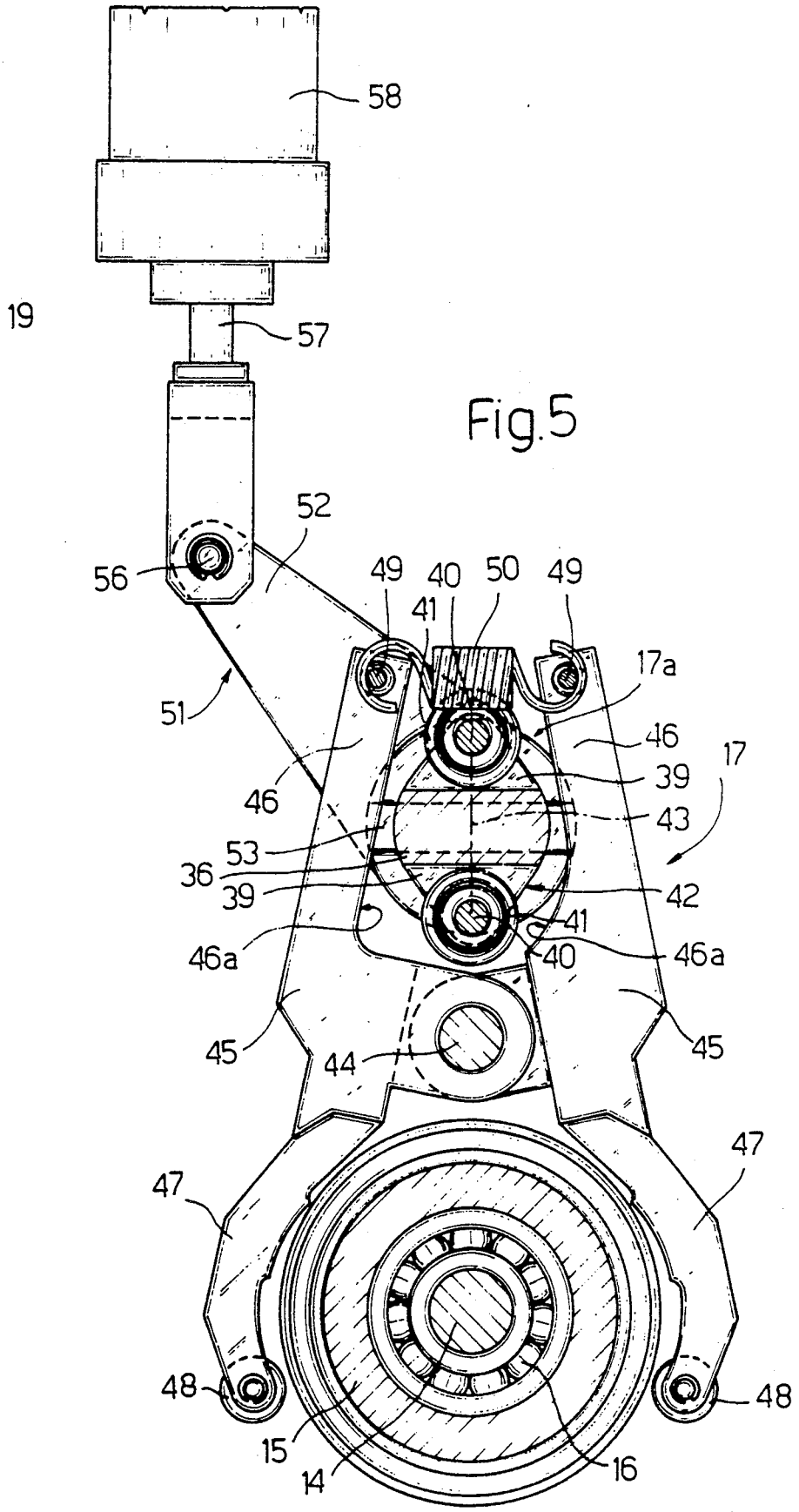

As shown more clearly on device 9 to the right in FIG. 3 and in FIGS. 4 and 5, the mid portion of said second intermediate portion 36 presents two symmetrical, peripheral milled portions 38 conferring on portion 36, when viewed laterally, the form of a double T, and defining two diametrically-opposed forks 39 in relation to the axis of shaft 30. Each fork 39 supports a pin 40 parallel to shaft 30 and defining the rotation axis of a respective bearing 41. Each bearing 41 projects from milled portion 38 and defines, together with intermediate portion 36, a cam element 42, the longer axis of symmetry 43 of which extends through the center of bearings 41, perpendicular to the direction of groove 34, and defines the maximum width direction of cam element 42.

Through holes 26 and 29 in walls 24 and 27, there extends a pin 44 about which pivot two jaws 45 of gripping means 17. Jaws 45 extend substantially vertically, pivot centrally about pin 44, and present a top control portion 46 extending inside hole 23 through supporting body 22, and a bottom grip portion 47 projecting downwards from through hole 23 and designed to engage bush 15. For this purpose, bottom portions 47 of jaws 45 are curved with their concave sides facing each other, and present a curve radius equal to the outside diameter of bus 15. The bottom ends of grip portions 47 support respective rollers 48 parallel to axis 11.

The inner surface 46*a* of top portion 46 of at least one of jaws 45 (the one on the right in FIGS. 4 and 5) defines a guiding surface for bearings 41 of cam element 42, and the top ends of both top portions 46 of jaws 45 present connecting pins 49 for the two ends of a return spring 50 for opening jaws 45 when shaft 30 is positioned as shown in FIG. 5 (with cam element 42 rotated so that axis 43 is vertical and bearings 41 are clear of portions 46 of jaws 45).

Rotation of shaft 30 is controlled by a lever mechanism 51 forming part of actuating device 19 and comprising a connecting rod 52 with an elongated projection or lock 53 on one end, the cross section of which is the same width as groove 34 on first end portion 33 of shaft 30 with which portion 33 it defines a prismatic joint 54. On the end connected to shaft 30, connecting rod 52 represents a pin 55 coaxial with shaft 30, when pressure roller 18 is raised, and connected for rotation to upright 5. Connecting rod 52 rotates about axis 55*a* of pin 55. The other end of connecting rod 52 pivots at 56 on the forked end of a rod 57 of a pneumatic actuator 58 of actuating device 19.

In actual use, for raising pressure roller 8 from the operating position contacting printing cylinder 6 into the maintenance position, e.g. for changing jacket 12, lifting devices 18 are activated for raising rods 21 into the FIG. 3 position. As, under normal operating conditions, rods 57 of actuators 58 are lowered for keeping respective locks 53 vertical, when each rod 21 is raised, the respective lock 53 slides inside respective groove 34 so as to connect actuating device 19 to shaft 30 of respective clamping device 17*a*. For each supporting device 9, therefore, when rod 57 is raised and connecting rod 52 rotated about axis 55*a* of pin 55, shaft 30 is rotated along with cam element 42, which moves into the FIG. 5 position wherein axis 43 is vertical and bearings 41 are detached from inner surface 46*a* of top portion 46 of jaws 46, which are therefore opened by return spring 50.

By releasing jaws 45 of gripping means 17 on either one of supporting devices 9 (e.g. the one on the right in FIG. 3), jacket 12 of pressure roller 8 can be pulled off from the same side (as shown by the dotted line in FIG. 3) through an opening (not shown) in upright 5, with pressure roller 8 supported at the opposite end.

By releasing jaws 45 of gripping means 17 on both supporting devices 9, the entire pressure roller 8 may be removed from printing unit 2.

Normal operation is restored by setting locks 53 back to the vertical position and lowering rods 21. The printing press according to the present invention therefore provides for troublefree disconnection of pressure rollers 8 from supporting devices 9 for changing the rollers, as well as for fast, troublefree replacement of jackets 12 without removing the entire pressure roller.

We claim:

1. A rotary printing press (1) for printing strip paper (3), the press (1) comprising at least one printing unit (2) through which the paper strip (3) is fed; a printing cylinder (6) supported on the printing unit (2); paper feed rollers (7) cooperable with the printing cylinder (6), one of the rollers (7) being a pressure roller (8) having a longitudinal axis (11); and a supporting device (9) connected for rotation to each end of the pressure roller (8); each supporting device (9) being supported on the printing unit (2) and comprising gripping means (17) for engaging the pressure roller (8); a lifting device (18) cooperable with the gripping means (17) for moving the pressure roller (8) in a given direction between an operating position, contacting the printing cylinder (6), and a detached position; and clamping means (17*a*) for clamping said gripping means (17) in a position engaging the pressure roller (8); the press (1) further comprising, for each supporting device (9), lock means (53) supported on the printing unit (2) and connectable to said clamping means (17*a*) when the pressure roller (8) is in said detached position; and an actuating device (19) for activating and moving said lock means (53) between an open position and a closed position for moving said clamping means (17*a*) to and from a position clamping said gripping means (17).

2. A printing press as claimed in claim 1, wherein said lock means (53) are mounted on the printing unit (2) so as to rotate, in relation to the printing unit (2) and by virtue of the actuating device (19), about a second axis (55*a*), parallel to said axis (11), between said open and closed positions.

3. A printing press as claimed in claim 2, wherein said clamping means (17*a*) comprise grooved rotary connecting means (34) for engaging the lock means (53); the grooved means (34) and the lock means (53) being aligned in said given direction when the lock means (53) are arranged in their closed position, and the clamping means (17*a*) are arranged in their clamped position; the grooved means (34) turning about said second axis (55*a*) when the pressure roller (8) is in said detached position, and defining, with the lock means (53) and in said detached position, a prismatic joint (54).

4. A printing press as claimed in claim 2, wherein the actuating device (19) comprises a connecting rod (52) cooperable with the lock means (53); and thrust means (58) connected to the connecting rod (52) for rotation thereof about said second axis (55*a*) together with the lock means (53).

5. A printing press as claimed in claim 2, wherein the gripping means (17) comprise a pair of jaws (45) connected to the clamping means (17*a*), which comprise a rotary shaft (30) having grooved means (34) and extending parallel to said axis (11), and a cam element (42) between said jaws (45); the cam element (42) being supported on said shaft (30) so as to rotate, with said shaft (30) and by virtue of the lock means (53), to and from said clamped position.

6. A printing press as claimed in claim 5, further comprising a supporting body(22) supporting said jaws (45); the supporting body (22) being connected to the lifting device (18), and said jaws pivoting centrally on a pin (44) both mutually and on the supporting body (22); each jaw (45) presenting a first curved end portion (47) for engaging the pressure roller (8), and a second end portion (46) opposite the first end portion (47); the second end portions (46) of the jaws (45) surrounding the cam element (42), defining facing guide surfaces (46*a*) for the cam element (42) and being connected to each other by a return spring (50).

7. A printing press as claimed in claim 6, wherein the cam element (42) is defined by an intermediate portion (36) of said shaft (30), said intermediate portion (36) being substantially ellipsoidal with its longer axis of symmetry (43) extending perpendicular to the grooved means (34); the intermediate portion (36) defining two forks (39) diametrically opposed in relation to the shaft (30) and located along said axis of symmetry (43); each fork (39) housing a bearing (41) supported for rotation and parallel to said axis (11) of the pressure roller (8); each said bearing (41) projecting from the respective fork (39) for engaging said guide surface (46*a*).

* * * * *